US006347403B1

(12) United States Patent
Wilcox

(10) Patent No.: US 6,347,403 B1
(45) Date of Patent: Feb. 19, 2002

(54) PROTECTIVE KNEE SYSTEM

(76) Inventor: Daniel W. Wilcox, 5 Hapsburg Ct., Baltimore, MD (US) 21234

( * ) Notice: Subject to any disclaimer, the term of this patent is extended or adjusted under 35 U.S.C. 154(b) by 0 days.

(21) Appl. No.: 09/693,914

(22) Filed: Oct. 20, 2000

(51) Int. Cl.[7] ..... A41D 13/06; A41D 1/06
(52) U.S. Cl. ..... 2/23; 2/24
(58) Field of Search ..... 2/22, 23, 24, 227, 2/231, 267, 16, 908, 911; 602/23, 26, 20

(56) References Cited

U.S. PATENT DOCUMENTS

| | | | | | |
|---|---|---|---|---|---|
| 2,568,083 | A | * | 9/1951 | Mitchell | 2/231 |
| 3,168,746 | A | * | 2/1965 | Smith | 2/24 |
| 3,772,704 | A | | 11/1973 | Carbonneau | |
| D229,643 | S | | 12/1973 | Bednarczuk | |
| 4,488,314 | A | * | 12/1984 | Johnson | 2/23 |
| 4,561,123 | A | * | 12/1985 | Hull | 2/23 |
| 4,613,991 | A | * | 9/1986 | Grover | 2/23 |
| 4,831,666 | A | * | 5/1989 | Denman | 2/23 |
| 4,893,355 | A | | 1/1990 | Ritter | |
| 4,920,577 | A | * | 5/1990 | Scharf | 2/24 |
| 5,038,408 | A | * | 8/1991 | DeBaene | 2/23 |
| 5,105,473 | A | * | 4/1992 | Valtakari | 2/227 |
| 5,594,954 | A | | 1/1997 | Huang | |
| 5,634,211 | A | | 6/1997 | Chen | |
| 5,732,412 | A | | 3/1998 | Holden | |
| 6,029,273 | A | * | 2/2000 | McCrane | 2/24 |
| 6,070,267 | A | * | 6/2000 | McKewin | 2/23 |

* cited by examiner

*Primary Examiner*—Amy B. Vanatta

(57) ABSTRACT

A protective knee system for attaching a pair of knee pads to pair of pants to protect the wearer's knees. The protective knee system includes a pair of pants. The pair of pants is comprised of a pair of leg portions that includes a first panel, a second panel, an inseam and a side seam. There is a plate that includes a first surface and a second surface. There is also a panel that includes a front side, a back side, a top edge, a bottom edge and a pair of side edges. The plate is integrally attached to the front side of the panel. There is a fastening means for securing the panel to the pair of pants such that the pair of side edges of the panel are removably coupled to the inseam and the side seam of the pair of pants.

8 Claims, 4 Drawing Sheets

PROTECTIVE KNEE SYSTEM

BACKGROUND OF THE INVENTION

1. Field of the Invention

The present invention relates to kneepads and more particularly pertains to a new protective knee system for attaching a pair of kneepads to pair of pants to protect the wearer's knees.

2. Description of the Prior Art

The use of kneepads is known in the prior art. More specifically, kneepads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,732,412; U.S. Pat. No. 5,634,211; U.S. Pat. No. 3,772,704; U.S. Pat. No. 5,594,954; U.S. Pat. No. 4,893,355; and U.S. Pat. No. Des. 229,643.

While these devices fulfill their respective, particular objectives and requirements, the aforementioned patents do not disclose a new protective knee system. The inventive device includes a protective knee system. The system is comprised of a pair of pants. The pair of pants is comprised of a pair of leg portions that includes a first panel, a second panel, an inseam and a side seam. There is a plate that includes a first surface and a second surface. There is also a panel that includes a front side, a back side, a top edge, a bottom edge and a pair of side edges. The plate is integrally attached to the front side of the panel. There is a fastening means for securing the panel to the pair of pants such that the pair of side edges of the panel are removably coupled to the inseam and the side seam of the pair of pants.

In these respects, the protective knee system according to the present invention substantially departs from the conventional concepts and designs of the prior art, and in so doing provides an apparatus primarily developed for the purpose of attaching a pair of kneepads to pair of pants to protect the wearer's knees.

SUMMARY OF THE INVENTION

In view of the foregoing disadvantages inherent in the known types of kneepads now present in the prior art, the present invention provides a new protective knee system construction wherein the same can be utilized for attaching a pair of kneepads to pair of pants to protect the wearer's knees.

The general purpose of the present invention, which will be described subsequently in greater detail, is to provide a new protective knee system apparatus and method which has many of the advantages of the kneepads mentioned heretofore and many novel features that result in a new protective knee system which is not anticipated, rendered obvious, suggested, or even implied by any of the prior art kneepads, either alone or in any combination thereof.

To attain this, the present invention generally comprises a protective knee system. The system is comprised of a pair of pants. The pair of pants is comprised of a pair of leg portions that includes a first panel, a second panel, an inseam and a side seam. There is a plate that includes a first surface and a second surface. There is also a panel that includes a front side, a back side, a top edge, a bottom edge and a pair of side edges. The plate is integrally attached to the front side of the panel. There is a fastening means for securing the panel to the pair of pants such that the pair of side edges of the panel are removably coupled to the inseam and the side seam of the pair of pants.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective knee system apparatus and method which has many of the advantages of the kneepads mentioned heretofore and many novel features that result in a new protective knee system which is not anticipated, rendered obvious, suggested, or even implied by any of the prior art kneepads, either alone or in any combination thereof.

It is another object of the present invention to provide a new protective knee system which may be easily and efficiently manufactured and marketed.

It is a further object of the present invention to provide a new protective knee system which is of a durable and reliable construction.

An even further object of the present invention is to provide a new protective knee system which is susceptible of a low cost of manufacture with regard to both materials and labor, and which accordingly is then susceptible of low prices of sale to the consuming public, thereby making such protective knee system economically available to the buying public.

Still yet another object of the present invention is to provide a new protective knee system which provides in the apparatuses and methods of the prior art some of the advantages thereof, while simultaneously overcoming some of the disadvantages normally associated therewith.

Still another object of the present invention is to provide a new protective knee system for attaching a pair of kneepads to pair of pants to protect the wearer's knees.

Yet another object of the present invention is to provide a new protective knee system which includes a protective knee system. The system is comprised of a pair of pants. The pair of pants is comprised of a pair of leg portions that includes a first panel, a second panel, an inseam and a side seam. There is a plate that includes a first surface and a second surface. There is also a panel that includes a front side, a back side, a top edge, a bottom edge and a pair of side edges. The plate is integrally attached to the front side of the panel. There is a fastening means for securing the panel to the pair of pants such that the pair of side edges of the panel are removably coupled to the inseam and the side seam of the pair of pants.

Still yet another object of the present invention is to provide a new protective knee system that is easily worn and removed.

Even still another object of the present invention is to provide a new protective knee system that reduces the likelihood of the pants of the wearer bunching up around the wearer's knees.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
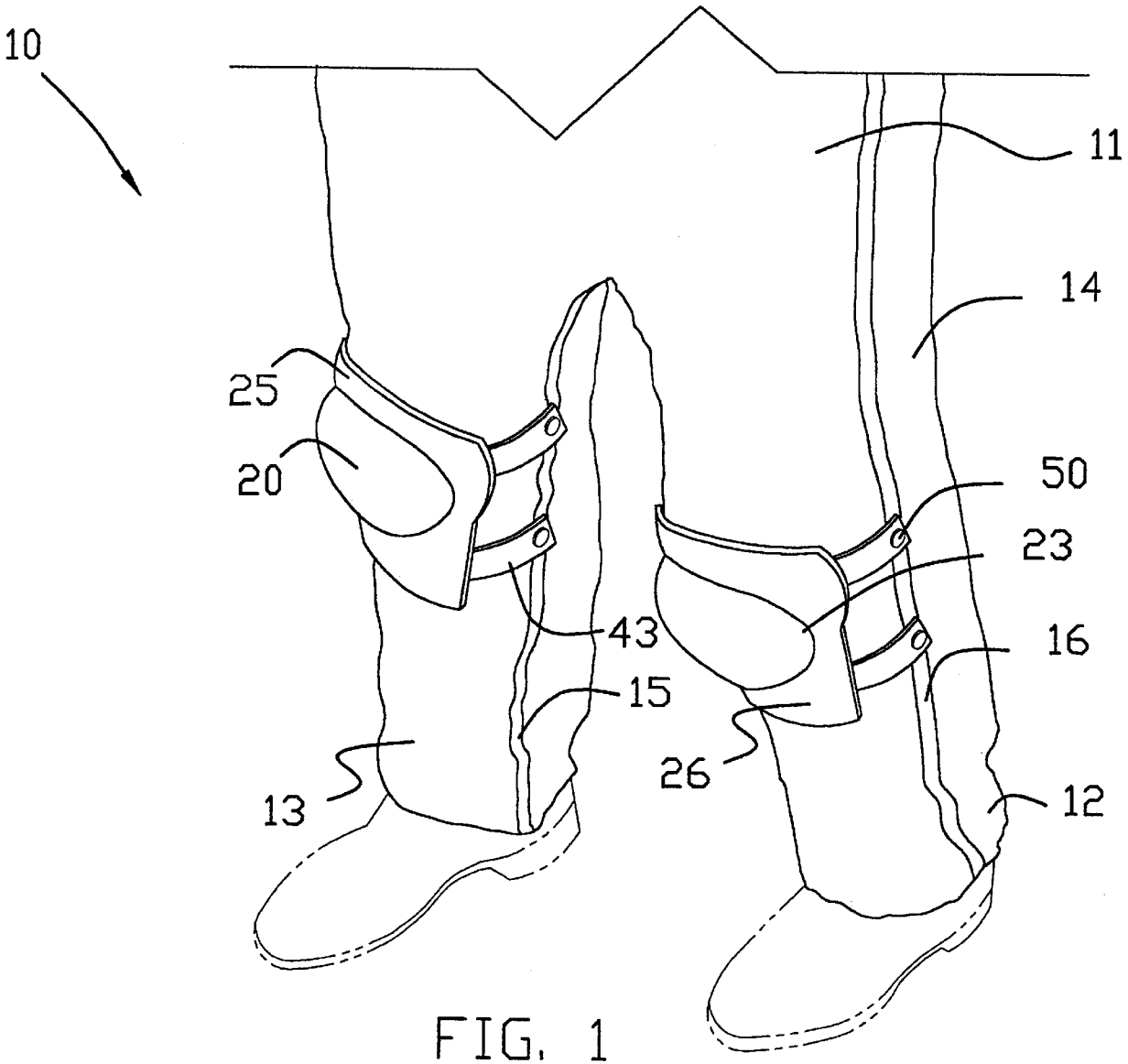
FIG. 1 is a schematic perspective view of a new protective knee system according to the present invention.
Figure 3:
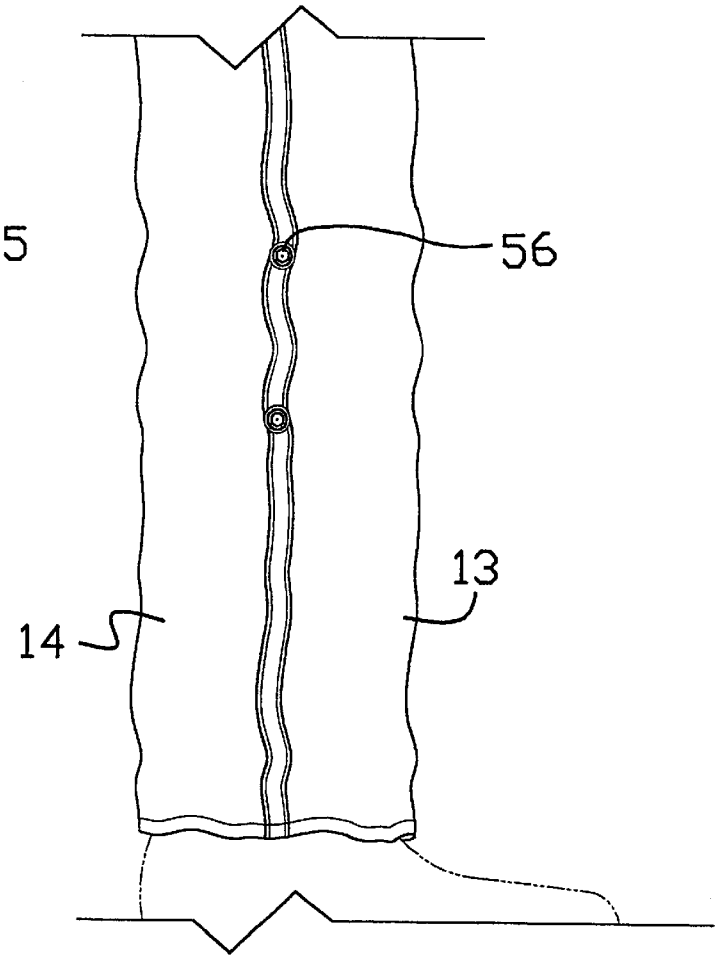
FIG. 3 is a schematic side view of the present invention showing the male securing members attached to one of the seams of the pair of pants.
Figure 2:
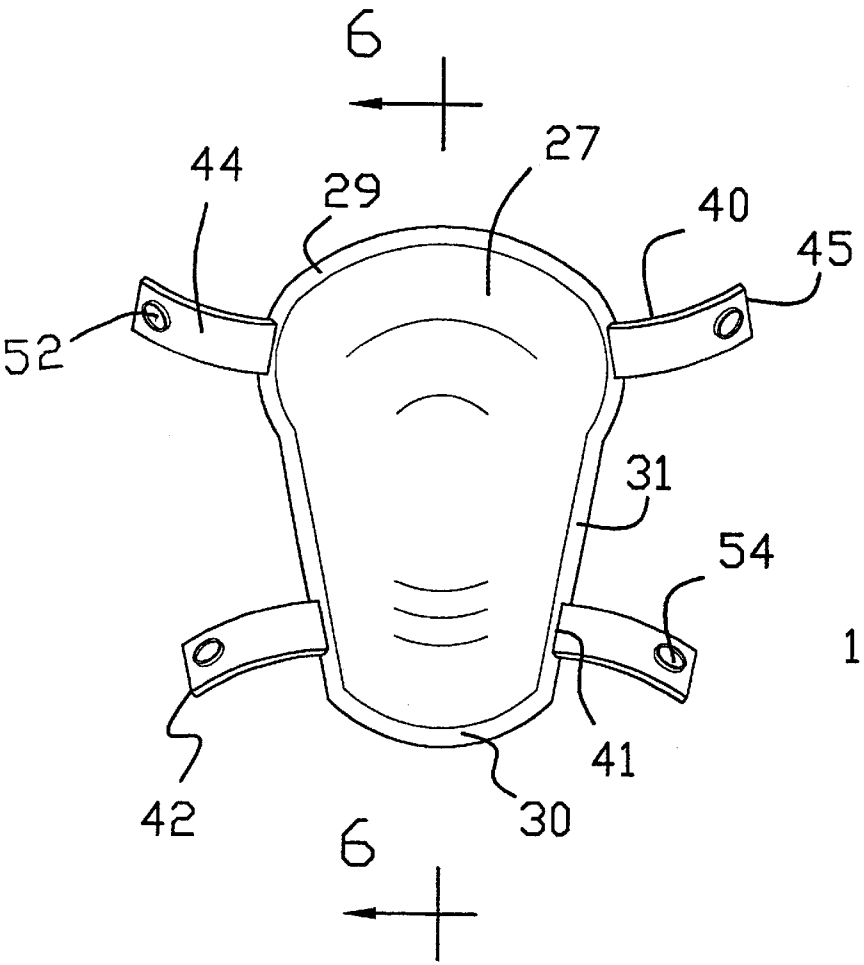
FIG. 2 is a schematic elevational side view of the present invention showing the back side of the panel with female snap portions attached to the straps.
Figure 5:
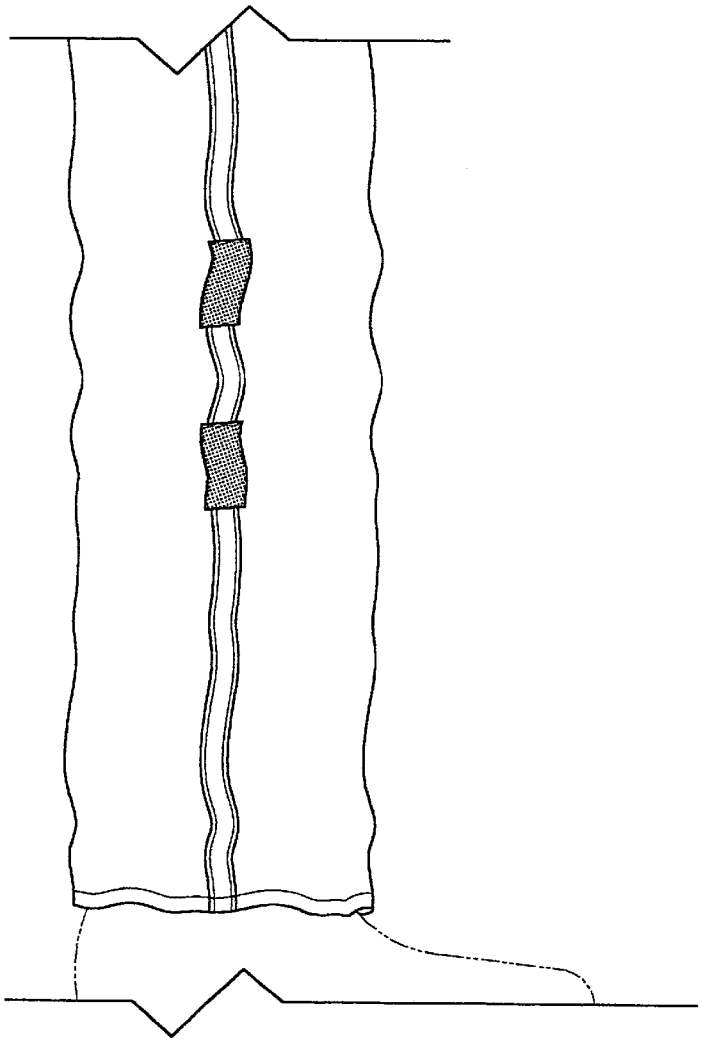
FIG. 5 is a schematic side view of the present invention showing the placement of a pair of loop portions attached to the pair of pants.
Figure 4:
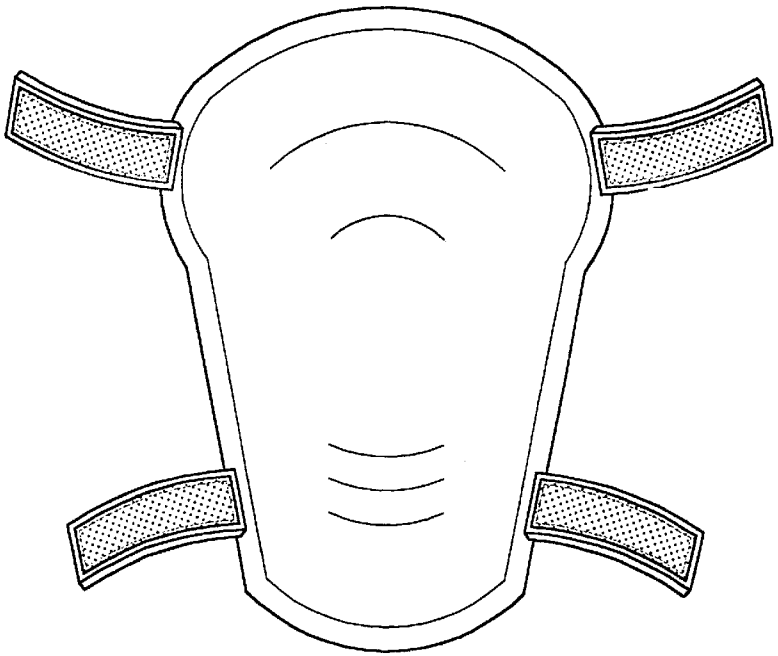
FIG. 4 is a schematic elevational side view of the present invention showing the use of a hook portion attached to the straps.
Figure 6:
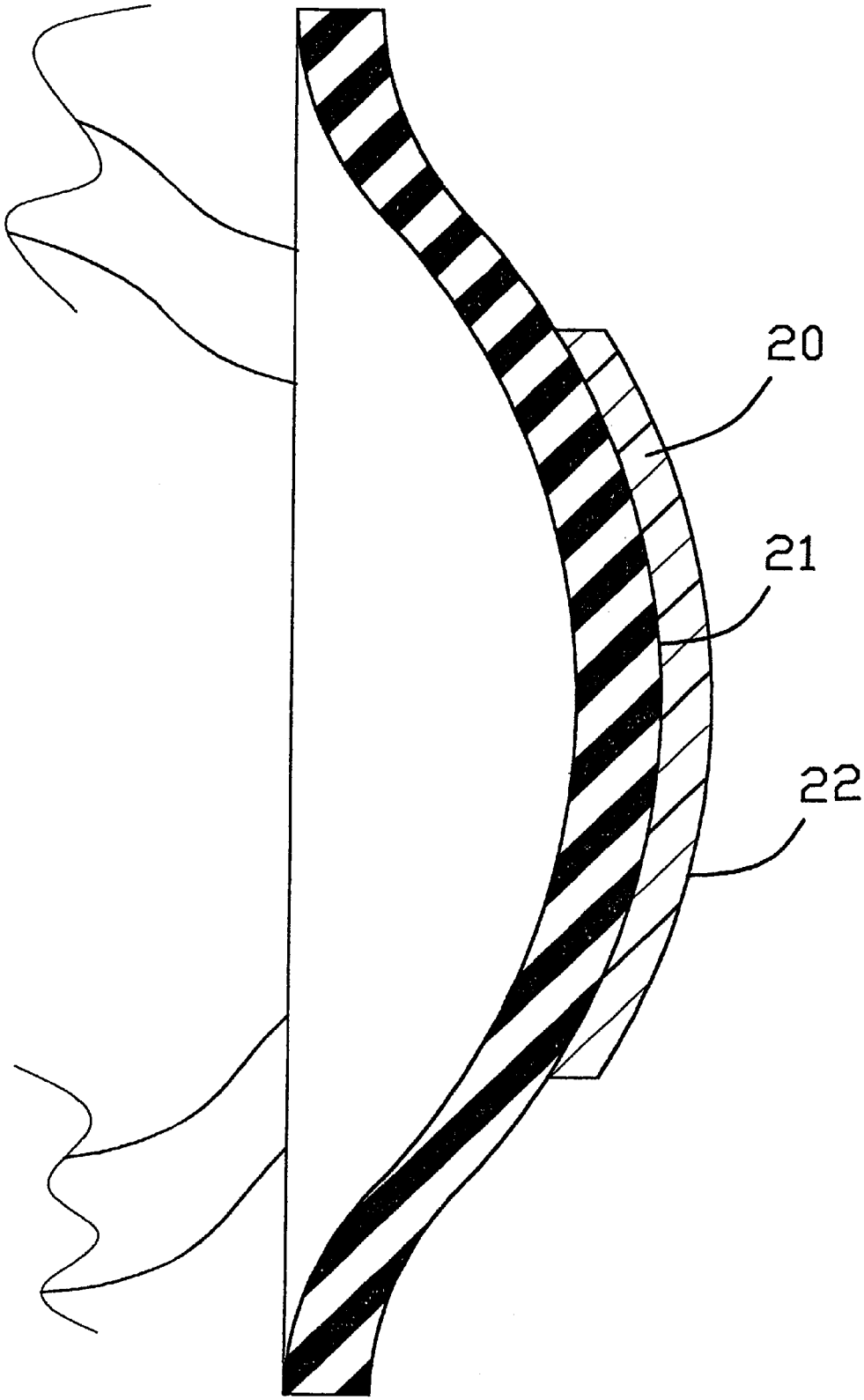
FIG. 6 is a schematic cross-sectional view of the present invention taken along line 6—6.

With reference now to the drawings, and in particular to FIGS. 1 through 6 thereof, a new protective knee system embodying the principles and concepts of the present invention and generally designated by the reference numeral 10 will be described.

As best illustrated in FIGS. 1 through 6, the protective knee system 10 generally comprises a protective knee system. The system comprises a pair of pants 11. The pair of pants 11 is comprised of a pair of leg portions 12. Each of the leg portions 12 includes a first panel 13, a second panel 14, an inseam 15 and a side seam 16.

The system also is comprised of a plate 20. The plate 20 includes a first surface 21 and a second surface 22. The first surface 21 of the plate 20 includes a generally concave shape. A peripheral edge 23 of the plate 20 has an oblong shape. The concave and oblong shape of the plate 20 allows for a better fit around a user's knee. The plate 20 is comprised of a molded and substantially rigid material such as plastic. Providing a protective shell between a user's knee and a foreign object.

The system further comprises a panel 25. The panel 25 includes a front side 26, a back side 27, a top edge 29, a bottom edge 30 and a pair of side edges 31. Each of the side edges 31 taper from the top edge 29 to the bottom edge 30. This allows the top edge 29 to receive a user's thigh and the bottom edge 30 to receive a user's lower leg. The plate 20 is positioned generally between the top edge 29 and the bottom edge 30 such that a long axis of the plate 20 is orientated generally parallel to the top edge 29. The panel 25 is comprised of a padding material such as foam or foam and cotton to absorb any impact encountered by the protective knee system 10.

The panel 25 is also comprised of a plurality of straps 40. Each of the straps 40 includes a first end 41, a second end 42, a first side 43 and a second side 44. The first end 41 of each of the straps 40 is securably attached to one of the side edges 31 such that each of the side edges 31 has a pair of straps 40 extending away therefrom. Each of the straps includes a free end 45. Each of the straps is also made of a resiliently flexible material such as an elastic fabric.

There are a plurality of securing means 50 for securing the straps 40 to the inseam 15 and the side seam 16 of each of the leg portions 12. Each of the securing means 50 is comprised of a snap member 52. The snap member 52 is comprised of a female portion 54. The female portion 54 is securably coupled to one of the straps 40. The female portion 54 is positioned generally adjacent to the free end 45 of one of the straps 40.

The securing means 50 is also comprised of a male portion 56. The male portion 56 is securably coupled to the inseam 15 and the side seam 16 of each of the leg portions 12. The male portion 56 is positioned generally adjacent to a user's knee. The male portion 56 includes a size and shape designed for being removably coupled to the female portion 54.

The securing means 50 can also be comprised of a tape fastening member. The tape fastening member is comprised of a hook portion and a loop portion. The hook portion would be attached to the strap, while the loop portion would be attached to the inseam 15 and the side seam 16 of the pair of pants 11. The loop portion has a size and shape designed for receiving the hook portion.

In an embodiment there are four securing means 50. Two are positioned in the inseam 15 and two are positioned in the side seam 16. In an embodiment a pair of devices may be used to protect both knees of a user.

In use, the user wears the pair of pants 11. The user then places his or her knee into the second side of the panel 25. The user then fastens the straps 40 to the inseam 15 and the side seam 16, thus, securing the panel 25 to the leg portions 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective knee system, said system comprising:

a pair of pants, said pair of pants comprising a pair of leg portions, each of said leg portions having a first panel, a second panel, an inseam and a side seam;

a plate, said plate having a first surface and a second surface;

a panel, said panel having a front side, a back side, a top edge, a bottom edge and a pair of side edges, said plate being integrally attached to said front side of said panel; and a fastening means for securing said panel to said pair of pants, such that said pair of side edges of said panel are removably coupled to said inseam and said side seam of said pair of pants.

2. The protective knee system of claim 1, wherein each of said side edges of said panel further comprises:

each of said side edges of said panel tapering from said top edge to said bottom edge, said panel comprising a padding material.

3. The protective knee system of claim 1, wherein said first surface of said plate further comprises:

said first surface of said plate having a generally concave shape, a peripheral edge of said plate having an oblong shape, said plate comprising a substantially rigid material.

4. The protective knee system of claim 1, further comprising:

a plurality of straps, each of said straps having a first end, a second end, a first side and a second side, said first end of each of said straps being securably attached to one of said side edges of said panel such that each of said side edges has a pair of straps extending away therefrom, each of said straps having a free end, each of said free ends being securably attached to said inseam and said side seam of each of said pants legs.

5. The protective knee system of claim 4, further comprising:

a plurality of securing means for securing said straps to said inseam and said side seam of each of said leg portions, each of said securing means comprising a snap member, said snap member comprising;

a female portion, said female portion being securably coupled to one of said straps; and a male portion, said male portion being securably coupled to said inseam and said side seam of each of said leg portions, said male portion having a size and shape adapted for being removably coupled to said female portion.

6. The protective knee system of claim 4, further comprising:

a plurality of securing means for securing said straps to said inseam and said side seam of each of said leg portions, each of said securing means comprising a fastening tape member, said fastening tape member comprising;

a hook portion, said hook portion being securably attached to one of said straps; and a loop portion, said loop portion being securably attached to said inseam and side seam of each of said leg portions, said loop portion having a size and shape adapted to receiving said hook portion.

7. A protective knee system, said system comprising:

a pair pants, said pair of pants comprising a pair of leg portions, each of said leg portions having a first panel, a second panel, an inseam and a side seam;

a plate, said plate having a first surface and a second surface, said first surface of said plate having a generally concave shape, a peripheral edge of said plate having an oblong shape, said plate comprising a substantially rigid material;

a panel, said panel having a front side, a back side, a top edge, a bottom edge and a pair of side edges, each of said side edges tapering from said top edge to said bottom edge, said plate being positioned generally between said top edge and said bottom edge such that a long axis of said plate is orientated generally parallel to said top edge, said panel comprising a padding material;

a plurality of straps, each of said straps having a first end, a second end, a first side and a second side, said first end of each of said straps being securably attached to one of said side edges such that each of said side edges has a pair of straps extending away therefrom, each of said straps having a free end, each of said straps being made of a resiliently flexible material;

a plurality of securing means for securing said straps to said inseam and said side seam of each of said leg portions, each of said securing means comprising a snap member, said snap member comprising;

a female portion, said female portion being securably coupled to one of said straps, said female portion being positioned generally adjacent to said free end of one of said straps;

a male portion, said male portion being securably coupled to said inseam and said side seam of each of said leg portions, said male portion being positioned generally adjacent to a user's knee, said male portion having a size and shape adapted for being removably coupled to said female portion;

wherein there are four securing means; and wherein a pair of devices may be used.

8. A protective knee device, said device being removably attachable to a pair of seams of a pair of pants, said device comprising:

a plate, said plate having a first surface and a second surface, said first surface of said plate having a generally concave shape, a peripheral edge of said plate having an oblong shape, said plate comprising a substantially rigid material;

a panel, said panel having a front side and a back side, a top edge, a bottom edge and a pair of side edges, said side edges tapering from said top edge to said bottom edge, said plate being positioned generally between said top edge and said bottom edge such that a long axis of said plate is orientated generally parallel to said top edge, said panel comprising a padding material;

a plurality of straps, each of said straps having a first end, a second end, a first side and a second side, each of said straps having a first end securably attached to one of said side edges such that each of said side edges has a pair of straps extending away therefrom, each of said straps having a free end, each of said straps being made of a resiliently flexible material;

a plurality of securing means for securing said straps to the seams of a pant leg, each of said securing means comprising a snap member, said snap member comprising;

a female portion, said female portion being securably coupled to one of said straps, said female portion being positioned generally adjacent to said free end of one of said straps;

a male portion, said male portion being securably coupled to the seam of a user's pants, said male portion being positioned generally adjacent to a user's knee, said male portion having a size and shape adapted for being removably coupled to said female portion;

wherein there are four securing means; and wherein a pair of devices may be used.

* * * * *